United States Patent [19]

Chovich

[11] Patent Number: 4,682,546

[45] Date of Patent: Jul. 28, 1987

[54] PROJECTILE

[76] Inventor: Milija M. Chovich, 141-5th Ave. N., So. St. Paul, Minn. 55075

[21] Appl. No.: 914,293

[22] Filed: Oct. 2, 1986

[51] Int. Cl.[4] ..... F42B 9/20

[52] U.S. Cl. ..... 102/529; 102/501; 102/517; 244/3.23

[58] Field of Search ..... 102/398, 444, 498, 501, 102/502, 503, 517, 529; 244/3.1, 3.23, 3.24, 3.3

[56] References Cited

U.S. PATENT DOCUMENTS

| | | | |
|---|---|---|---|
| 2,884,859 | 5/1959 | Alexander et al. | 244/3.23 |
| 4,008,667 | 2/1977 | Look | 102/502 |
| 4,215,632 | 8/1980 | Sie | 102/529 |
| 4,262,597 | 4/1981 | Olson | 102/502 |
| 4,519,316 | 5/1985 | Bethmann et al. | 102/498 |
| 4,553,482 | 11/1985 | Weber et al. | 102/498 |

*Primary Examiner*—Harold J. Tudor

*Attorney, Agent, or Firm*—Thomas B. Tate

[57] ABSTRACT

The invention is a projectile which will not ricochet upon striking a solid object. The projectile has a hull containing a payload cavity with a liquid payload, rotors within the payload cavity, a threaded shaft extending the length of the hull, and propeller fins at the back end of the shaft which make fewer turns than the hull while the projectile is in flight.

1 Claim, 19 Drawing Figures

PROJECTILE

SUMMARY AND BACKGROUND OF THE INVENTION

Occasionally it is necessary for a policeman to fire at a fleeing criminal suspect in a crowded area. When conventional lead-filled bullets are used in this situation, the bullets will ricochet upon hitting a wall or other solid surface, thereby creating a risk of injury to innocent bystanders.

The advantages of the present invention are as follows:

(1) Because of the plastic hull and liquid mercury payload, this projectile will provide high expansion and destruction upon hitting the intended target.

(2) In case the projectile misses the intended target and strikes a wall or other solid surface, the projectile will totally disintegrate upon impact, thereby eliminating ricochet and the risk of harm to unintended targets.

(3) In case of complete misses, the projectile will travel intact until it reaches its self-destruction range and then will totally disintegrate within a few feet of that range, thus eliminating the risk of injury from stray bullets. The range is determined by the threading on the shaft and the angle of the propeller fins relative to the incoming air.

DESCRIPTION OF THE DRAWINGS

FIGS. 6A through 9B depict individiual parts.

FIG. 6A is a longitudinal section of the retaining nut.

FIG. 9B is a front view of the hull.

FIG. 10—the projectile is inside the gun barrel.

FIG. 11—exiting the gun barrel.

FIG. 12—downrange, start of self-destruction.

FIG. 13—further downrange, self-destruction progresses.

FIG. 14—total self-destruction.

FIG. 15—short distance beyond self-destruction point, motion terminated, parts fall to the ground.

DESCRIPTION OF THE PREFERRED EMBODIMENT OF THE INVENTION

Figure 1:
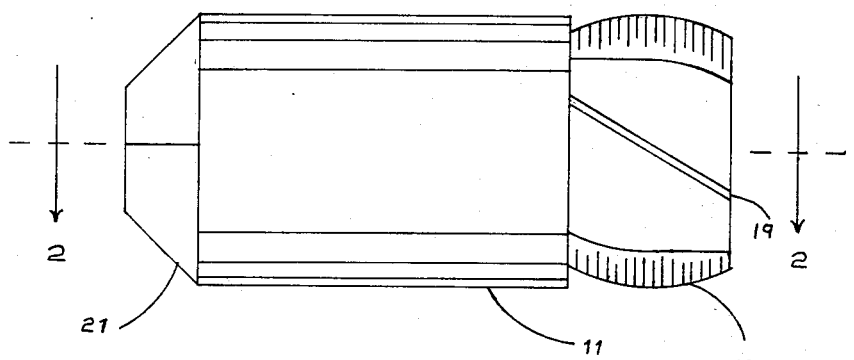
FIG. 1 is an exterior side view.
Figure 2:
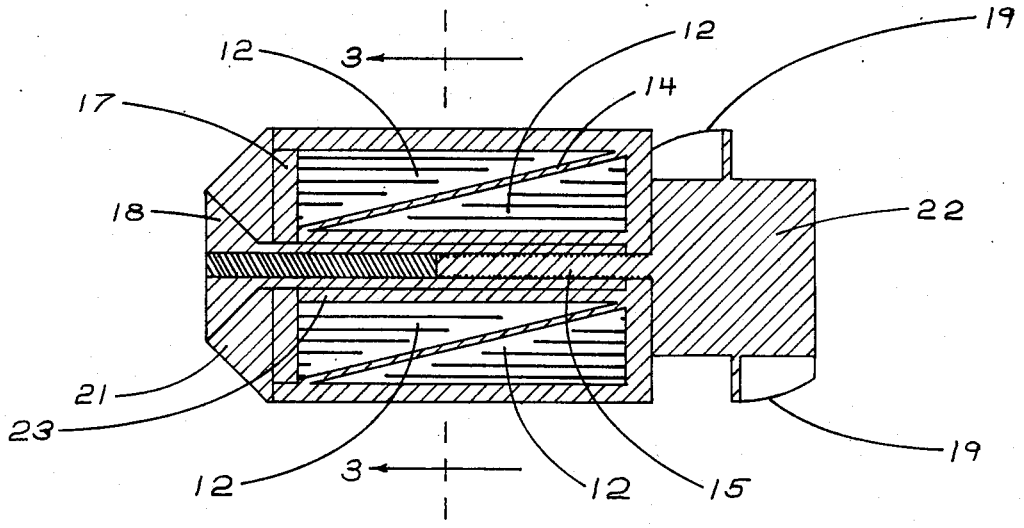
FIG. 2 is a longitudinal section taken along line 2—2 of FIG. 1.
Figure 3:
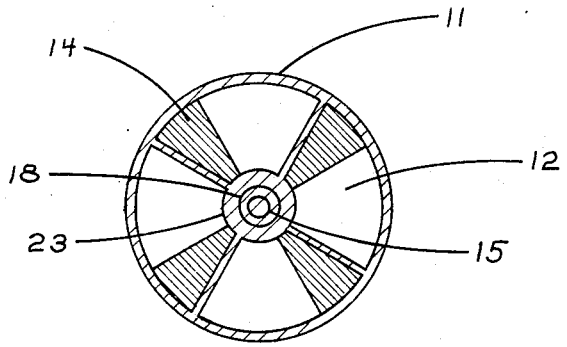
FIG. 3 is a cross section taken along line 3—3 of FIG. 2.
Figure 4:
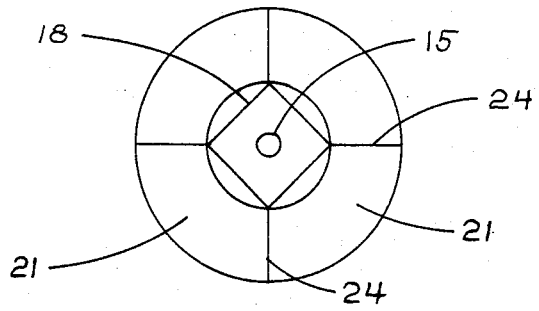
FIG. 4 is a front view.
Figure 5:
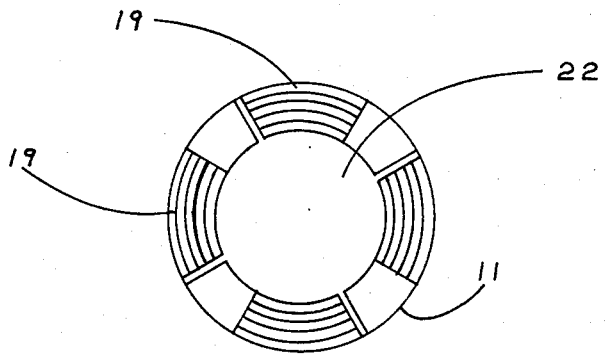
FIG. 5 is a back view.
Figure 6A:
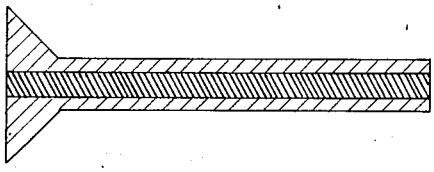
Figure 6B:
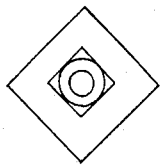
FIG. 6B is a back view of the retaining nut.
Figure 7A:
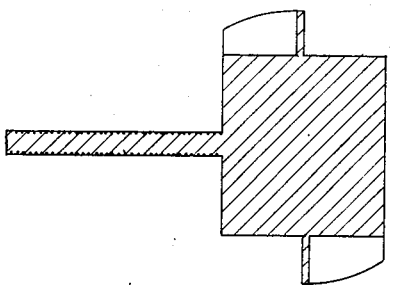
FIG. 7A is a longitudinal section of the retaining bolt assembly.
Figure 7B:
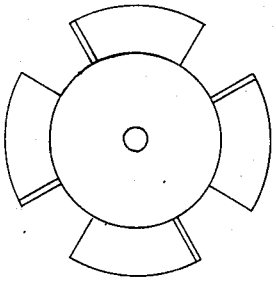
FIG. 7B is a front view of the retaining bolt assembly.
Figure 8A:
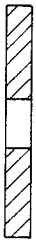
FIG. 8A is a longitudinal section of the sealing washer.
Figure 8B:
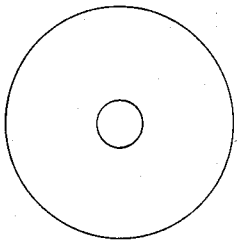
FIG. 8B is a front view of the sealing washer.
Figure 9A:
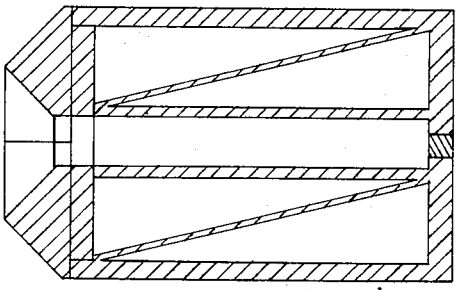
FIG. 9A is a longitudinal section of the hull.
Figure 9B:
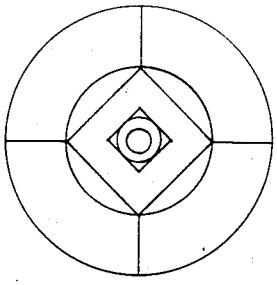
Figure 10:
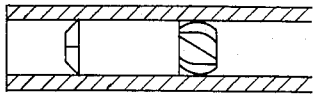
FIGS. 10 through 15 are an action sequence, as follows.
Figure 11:
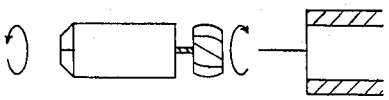
Figure 12:
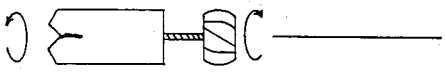
Figure 13:
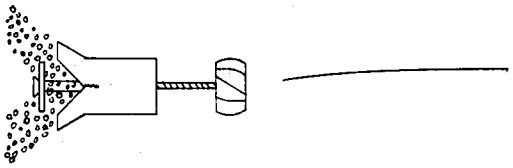
Figure 14:
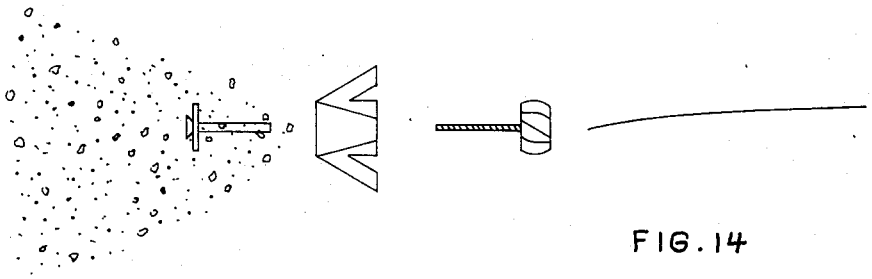
Figure 15:
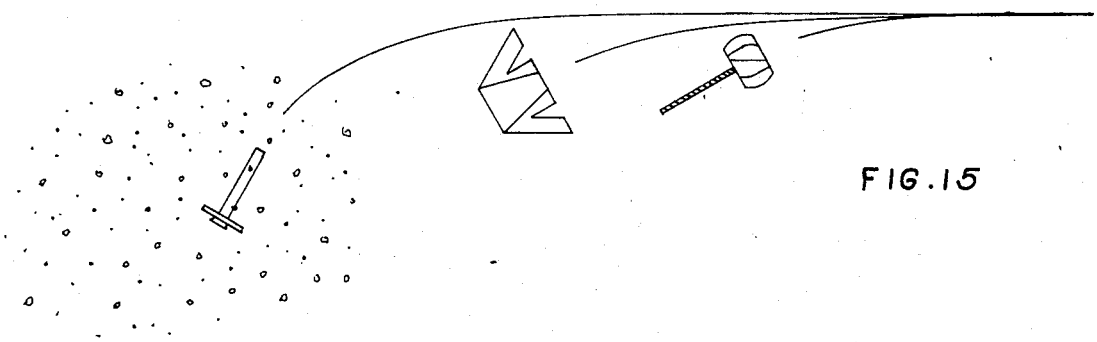

The invention is a self-destructing projectile which has an adjustable, predetermined range before destruction. The projectile is made entirely of high-impact plastic, except for the liquid mercury payload inside.

The projectile has an outer hull 11, which defines central payload cavities 12 which are filled with liquid mercury. A plurality of roters 14 are disposed within payload cavities 12 to spin the mercury payload, and are angled so as to correspond to the angles of the rifling in the barrel of the gun from which the projectile will be fired. The roters 14 are attached to the rotor stem 23 and to the inner sides of hull 11.

A retaining bolt 15 extends part or all of the length of the projectile, being fitted through an opening in the back wall of the hull 11 (said opening in the back wall being grooved to correspond to the threading of the bolt 15), extending through the payload cavities 12, and projecting through an opening in the front wall of hull 11. The bolt 15 is held in place at its anterior end by a reteining nut 18, which is disposed within a slotted nose cone 21 having nose slots 24. A sealing washer 17 is used to make a waterproof seal. The bolt 15 has, at its posterior end, a plurality of fins 19 arranged around a hub 22 which can be either circular or rectangular. The number of fins 19 may be two, three, four, or more.

The fins 19 are angled slightly greater than the rotors 14. The range is predetermined by the number of threads on the nut 18 (the more threads, the longer the bolt 15 takes to unscrew), how coarse the threads are, and by the pitch of the fins 19 as opposed to the projectile's rotation. A typical range for these projectiles is thirty to fifty yards, but it can be more or less.

When, at the predetermined range, the bolt 15 completely unscrews from the nut 18, the four nosepieces 21 split apart due to centripetal force and air pressure, causing the outside of the hull to peel back. The mercury payload is spilled out in all directions, causing the projectile to slow to zero velocity within a few feet. Because the projectile bursts open and the mercury payload splatters into small droplets, the projectile will not ricochet upon striking a solid object.

I claim:

1. A projectile which will self-destruct at a predetermined range and which will not ricochet upon striking a solid object, said projectile comprising:

a hull having a slotted nose cone;

payload cavities formed within said hull, said payload cavities being filled with a liquid payload;

a plurality of rotors disposed within said payload cavities;

a retaining bolt extending at least part of the length of said hull through said payload cavities, said bolt extending through openings at the anterior and posterior ends of said hull;

a retaining nut disposed within said nose cone, said nut holding said shaft in position at the anterior end of said bolt;

two or more fins formed around a hub at the posterior end of said retaining bolt, said fins forming angles with the horizontal axis of said projectile such that said fins rotate more slowly than said hull, thus allowing said retaining bolt to unscrew from said retaining nut while said projectile is in flight.

* * * * *